US005788080A

United States Patent [19]

Sill et al.

[11] Patent Number: 5,788,080

[45] Date of Patent: Aug. 4, 1998

[54] STACKED OPENABLE AND RECLOSABLE PLASTIC BAGS ON A DISPENSER

[75] Inventors: Jonathan Sill, Caledonia; Todd Sill, Lewis Center, both of Ohio; Gary Bechtold, West Chester, Pa.

[73] Assignee: inno-pak, inc., Delaware, Ohio

[21] Appl. No.: 892,369

[22] Filed: Jul. 14, 1997

[51] Int. Cl.[6] ..... B65D 85/62; B65D 33/24

[52] U.S. Cl. ..... 206/554; 383/7; 383/37

[58] Field of Search ..... 206/554; 383/7, 383/9, 13, 29, 37

[56] References Cited

U.S. PATENT DOCUMENTS

| | | | |
|---|---|---|---|
| 4,615,045 | 9/1986 | Siegel | 383/9 |
| 4,630,311 | 12/1986 | Bentson | 383/37 |
| 4,846,586 | 7/1989 | Bruno | 383/9 |
| 5,100,000 | 3/1992 | Huseman | 206/554 |
| 5,525,363 | 6/1996 | Herber et al. | 383/9 |
| 5,575,393 | 11/1996 | Gebhardt | 206/554 |
| 5,682,730 | 11/1997 | Dobreski et al. | 206/554 |

*Primary Examiner*—Jimmy G. Foster
*Attorney, Agent, or Firm*—Porter, Wright, Morris & Arthur

[57] ABSTRACT

A plurality of stacked openable and reclosable plastic bags on a dispenser is provided which includes a pocket formed by front and back walls for form a mouth portion leading to the pocket, complementary separable zipper profiles on the front and back walls to allow the plastic bags to be openable and closable, a perforation extending across the back wall extension portion above the zipper profiles, wherein the strength of the zipper profiles is greater than the strength of the perforation such that pulling on the zipper profiles when the zipper profiles are closed tears each bag from the dispenser without causing the zipper profiles to separate.

8 Claims, 4 Drawing Sheets

STACKED OPENABLE AND RECLOSABLE PLASTIC BAGS ON A DISPENSER

FIELD OF THE INVENTION

The present invention generally relates to stacked openable and reclosable plastic bags having complementary zipper profiles that are suspended from a support structure.

BACKGROUND AND SUMMARY OF THE INVENTION

Various types of plastic bags are available for holding and storing various types of items including sandwiches, meat, fruits, vegetables, etc. These plastic bags are generally made of a thin film of plastic and some of these bags include zipper profiles to seal the contents in the bag. Delis and other stores have a need for plastic bags to hold various items and it is necessary that the plastic bags be accessible and function for the desired use.

Various types of plastic bags have been created and some have been patented, such as Membrino (U.S. Pat. No. 4,560,068), Membrino (U.S. Pat. No. 4,305,503), Huseman (U.S. Pat. No. 5,419,437), and Huseman (U.S. Pat. No. 5,100,000). U.S. Pat. Nos. 5,419,437 and 5,100,000 disclose a plurality of stacked plastic film bags wherein the strength of the perforation is greater than the strength of the zipper profiles such that pulling on the lip first causes the zipper profiles to separate and thereafter causes the bag to be separated from the header. These patents teach away from the present invention in which the strength of the perforation is less than the strength of the zipper profiles. The plastic bags disclosed in U.S. Pat. Nos. 5,419,437 and 5,100,000 typically have weak and flimsy zipper profiles since the strength of the perforation is strength of the perforation is greater than the strength of the zipper profiles. With these weak zipper profiles, the bags tend not to seal very tightly and there is the risk of the contents spilling or falling out of the bag if the seal formed by the zipper profiles does not stay closed. With the plastic bags disclosed in U.S. Pat. Nos. 5,419,437 and 5,100,000, if the strength of the zipper profiles is strong, the perforation has to be stronger since those inventions disclose and teach that the strength of the perforation is greater than the strength of the zipper profiles. Thus, the perforation must be very strong which makes it very difficult for the user to tear the bags off of the dispenser by tearing the perforation. U.S. Pat. Nos. 5,419,437 and 5,100,000 disclose a pad of plastic bags that are closed while they are on the dispenser before the user wants to fill the plastic bags. Therefore, the user must pull on the lip of the bags to open the zipper profiles before items can be placed in the bags. It would be useful if these plastic bags were already open while they are on a dispenser prior to the user having to pull on a lip to open the zipper profiles of the plastic bags.

The present invention overcomes the drawbacks of the previous inventions by providing a stack of openable and reclosable plastic bags that can be placed on a dispenser and that are open and available for the user to use without having to open the zipper profiles of the plastic bags, as well as having strong zipper profiles that retain the contents in the plastic bag so that accidental spilling is less likely to occur from the zipper profiles being accidentally opened. The strength of the zipper profiles of the present invention is greater than the strength of the perforations. This also provides for easy removal of the plastic bags when tearing the plastic bags at the perforation, while still having a plastic bag that has strong zipper profiles. The present invention provides plastic bags that can be easily filled by the user opening the plastic bag prior to the plastic bag being torn from the dispenser and also enables a user to fill the plastic bag while it is still on the dispenser and be able to close the complementary zipper profiles to seal the contents in the plastic bag prior to tearing the bag from the dispenser at the perforation (without having pegs or other support apparatus holding up the plastic bags).

DETAILED DESCRIPTION OF THE PREFERRED EMBODIMENTS

Figure 1:
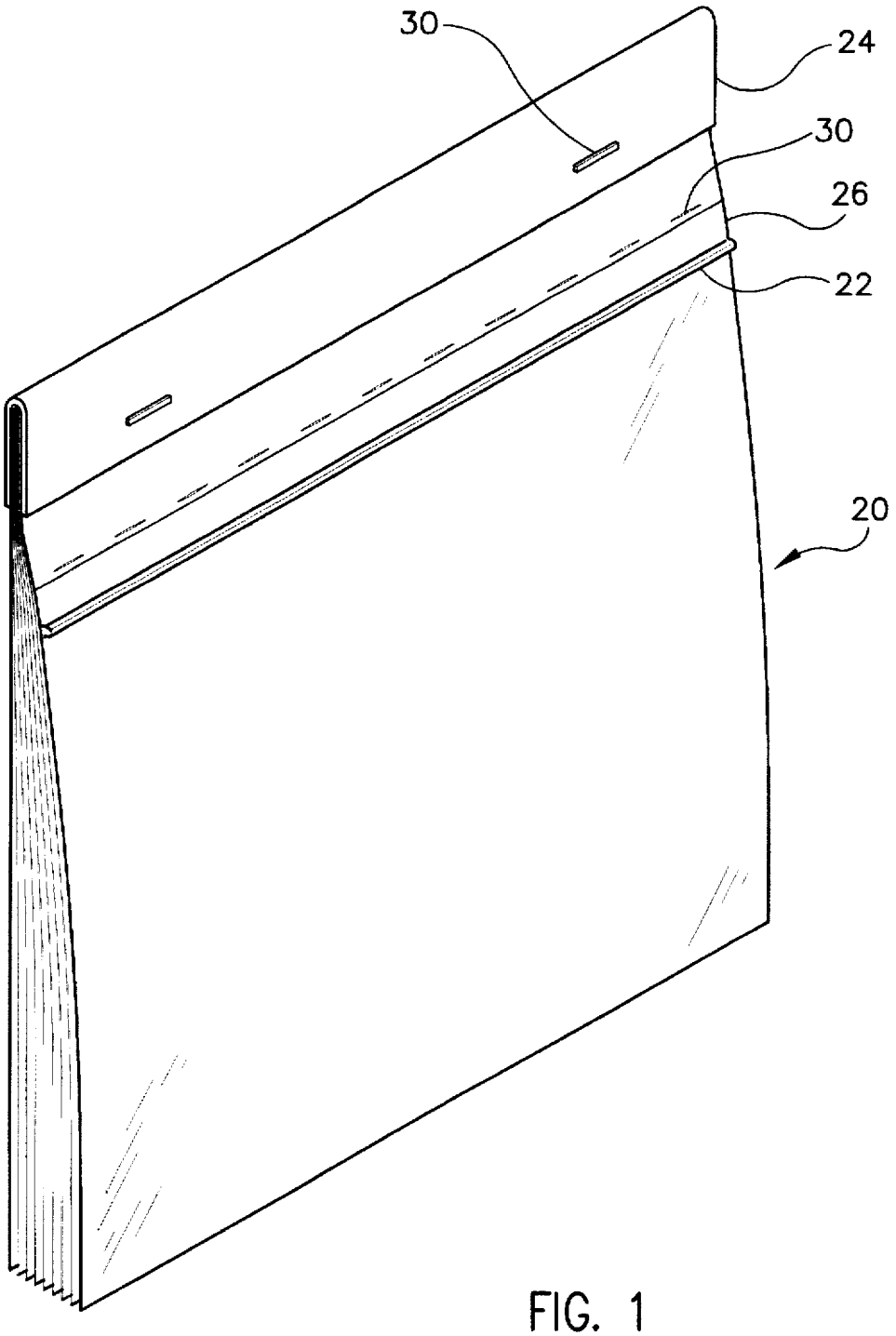
FIG. 1 is a perspective view of the plastic bag suspended from the dispenser according to the present invention.

As shown in the drawings, a stack of plastic bags generally indicated as 20 is connected to a dispenser header 24 from which the stack of openable and reclosable plastic bags 20 are suspended. Each of the plastic bags that make up the stack of plastic bags 20 includes a front wall 14 and back wall 16. These walls 14 and 16 are preferably made of a thin plastic film of polyethylene or other suitable plastic material for forming such bags. Walls 14 and 16 are connected together at seams along their peripheral edges, except for their upper edges, by heat-sealing or other suitable means for connecting walls 14 and 16. Some of these seams joining walls 14 and 16 may not be heat-sealed but rather made to be folded as one integral piece of plastic film. This typically is the bottom seam that may just be a fold of the plastic film whereas the longitudinal wall seams are heat-sealed.

Figure 4:
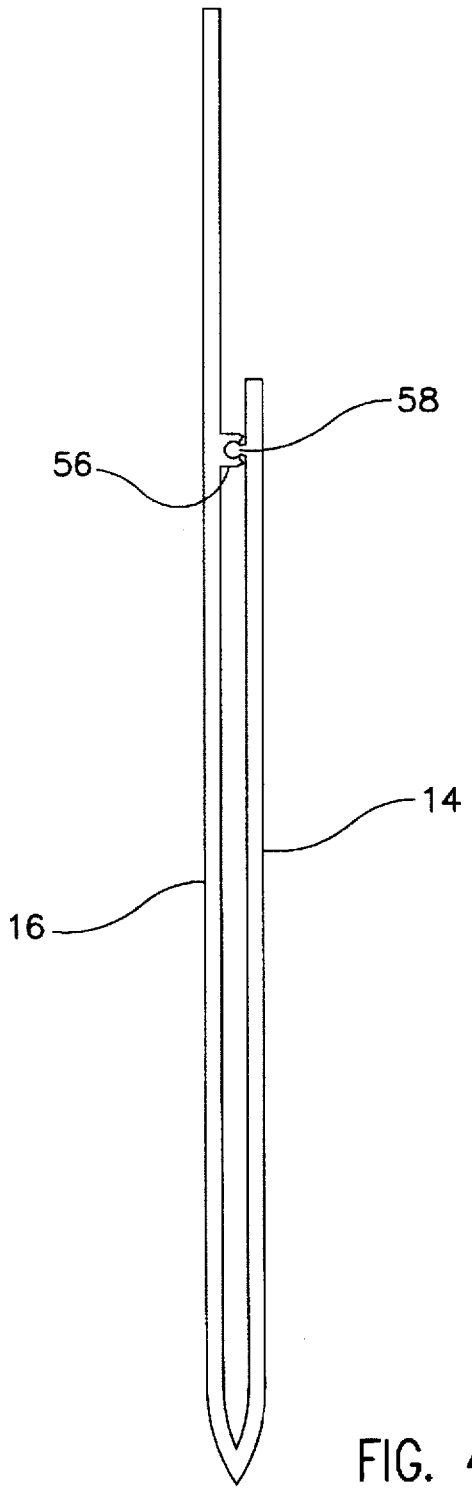
FIG. 4 is a cross sectional cut away side view of a suspendable plastic bag shown in FIG. 1 taken along line 1—1.

The front wall 14 and back wall 16 form a pocket therebetween. The pocket is accessible when the complementary zipper profiles 56 and 58 are separated or open. The complementary zipper profiles 56 and 58 constitute a sealable "zipper" 22 that is provided near the mouth or opening of the plastic bags so that the plastic bags may be sealed and unsealed. The complementary zipper profiles 56 and 58 are typically located on walls 14 and 16 and are integral therewith. FIG. 4 shows complementary zipper profile 56 is groove element on the back wall 16 and complementary zipper profile 58 is a rib element on the front wall 14. The rib and groove elements fit together to form a seal to close the plastic bags. It should be noted that complementary zipper profile 56 may be a rib element and complementary zipper profile 58 can be the groove element.

Figure 2:
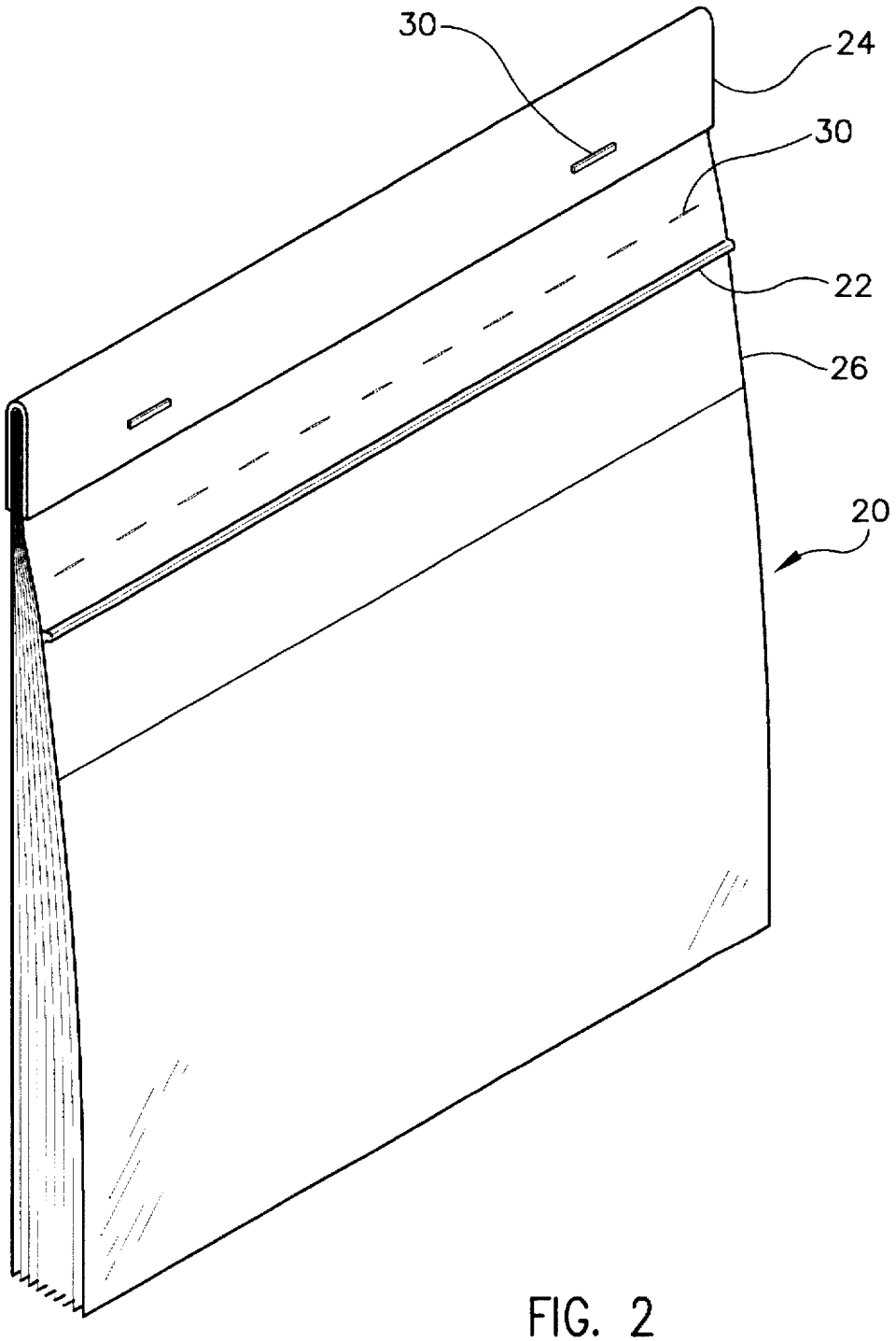
FIG. 2 is a perspective view of another embodiment of the plastic bag suspended from the dispenser according to the present invention.

The present invention also includes a lip that is preferably an extension that is provided on the front wall 14 either extending upwardly from zipper 22 as shown in FIG. 1 or extending downwardly from zipper 22 as shown in FIG. 2. Lip 26 is provided for gripping by the user to pull the front wall 14 away from the back wall 16 to get access to the pocket.

An extension wall of back wall 16 is preferably integral with back wall 16. Each of suspension walls of the stack of plastic bags 20 preferably are connected to the dispenser header 24. This connection may be by staples 30 or other means suitable to allow the suspension of the stack of plastic bags 20 from the header dispenser 24.

The back wall extension portion of each of the plastic bags includes a perforation between the header dispenser 24 and the zipper 22. It is preferable that a perforation or score is provided horizontally from one lateral edge of the suspension wall to the other lateral wall of the suspension wall so that the plastic bags can be torn or severed from the dispenser header.

In accordance with the present invention, the strength of the zipper 22 is greater than the strength of the perforation 30 such that when the lip 26 is pulled when the zipper 22 is closed, the perforation 30 will tear so that the user can remove the sealed plastic bag from the dispenser header 24 without opening zipper 22. This provides the advantage that the user may fill the plastic bag and close zipper 22 and then pull on the plastic bag or the lip 26 to tear the plastic bag from the dispenser header 24 along the perforation 30 without having the zipper 22 open and possibly spill the contents of the plastic bag when tearing the plastic bag from the header dispenser. This also provides the advantage that the zipper 22 is strong so that use of the plastic bag after removal from the header dispenser 24 provides a strong seal which is very desirable to the user compared to bags that have a weaker seal and a stronger perforation.

Figure 3:
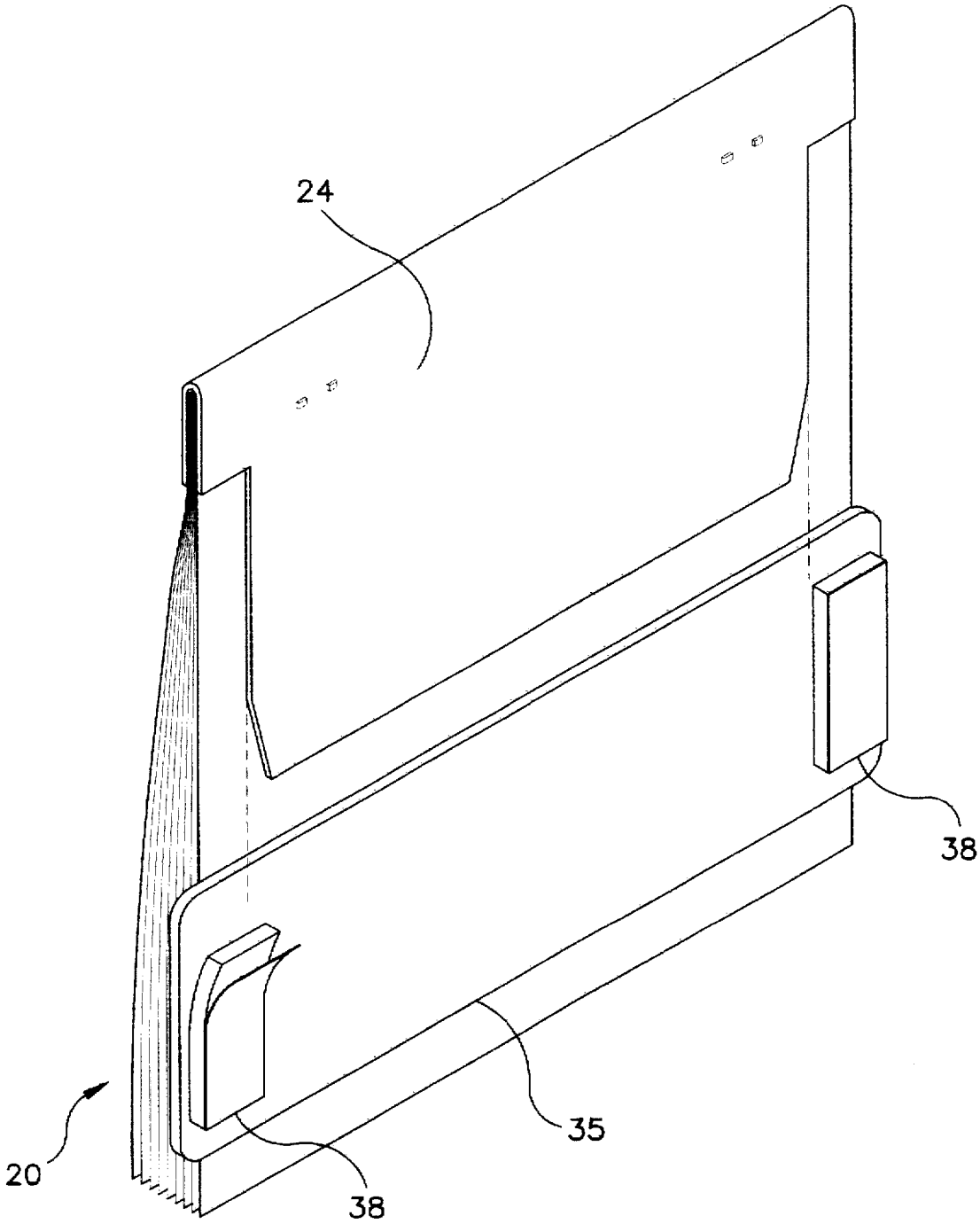
FIG. 3 is perspective rear view of the plastic bag suspended from the dispenser, including a dispenser card, according to the present invention.

The header dispenser 24 of the present invention is preferably a cardboard piece that is bent over the tops of the suspension walls of the stack of plastic bags 20 and through which a staple 30 or other connecting means is fastened so that the suspension walls of the stack of plastic bags 20 can be connected to each other and to the header dispenser 24. The header dispenser 24 preferably extends down from the front portion of the stack of plastic bags 20, and over and extends a distance further down the back side of the stack of plastic bags 20 as shown in FIG. 3. FIG. 3 also shows a dispenser card 35 and mounting means 38 that are preferably secured to each side of the dispenser card 35. The mounting means 38 preferably has paper that can be peeled off to expose adhesive backed velcro that allows the dispenser card 35 to be secured or adhered to a selected area that is easily accessible to the user of the stack of plastic bags 20. This dispenser card may also be secured to a wall or other area via fasteners, screws, nails, etc. The header dispenser 24 extends down the back side of the stack of plastic bags 20 and the extension of the header dispenser 24 fits over the top of the dispenser card 35. The dispenser card 35 supports the header dispenser 24 from which the stack of plastic bags 20 are suspended. This enables the user to place the stack of plastic bags 20 in a convenient location, as well as the ease to remove the dispenser card 24 after all of the plastic bags have been dispensed. A new stack of plastic bags on dispenser card 24 can be installed over the dispenser card 35. The dispenser card 35 should be rigidly secured to a wall or other surface so that if the user wants to fill the bags while they are still attached to the dispenser card 35, the dispenser card 35 and header dispenser 24 will support a filled plastic bag and enable the user to close the complementary zipper profiles 56 and 58 while the bag is still attached to the header dispenser 24. The user can then seal the bag via zipper 22 and then tear the filled bag at perforation 30.

It should be noted that the stack of plastic bags 20 may be attached to other types of dispensers and/or support structures. The stack of plastic bags 20 should be suspended and secured attached to the dispenser so that the bags can be filled while still attached to the dispenser thereby allowing the user to seal the zipper 22 and then tear the bag at the perforation 30. It should be noted that various methods can be used to connect the stack of plastic bags 20 to the dispenser card 35 which include staples, heat sealing, screws, fasteners, clamps, etc.

The typical use of the stack of plastic bags 20 is that the zipper 22 is open and the user can grab the lip 26 to open the bag and provide access to the pocket and drop items into the plastic bag while the bag is attached to the header dispenser 24. Since the bags are open before the user grabs the lip 26, the present invention allows the strength of the zipper 22 to be greater than the strength of the perforation 30. This avoids the use of flimsy or weak zippers and provides a much better product, i.e., a strongly sealed bag at zipper 22 to retain or hold items in the bag. After the bag is filled and sealed while on the header dispenser 24, the user can then pull on the lip 26 or pull on any part of the bag to then tear the bag at the perforation 30. An advantage of the present invention is that the user can pull on the lip 26 of the sealed bag and perforation 30 will tear and zipper 22 will not open. Again, this is because the strength of zipper 22 is greater than the strength of perforation 30.

Having described the invention in detail, those skilled in the art will appreciate that, given the present disclosure, modifications may be made to the invention without departing from the spirit of the inventive concept herein described. Therefore, it is not intended that the scope of the invention be limited to the specific and preferred embodiments illustrated and described. Rather, it is intended that the scope of the invention be determined by the appended claims.

What is claimed is:

1. A plurality of stacked openable and reclosable plastic bags on a dispenser, each of said bags comprising:

a front wall and a back wall connected together along their peripheral edges, except for their upper edges, to form a pocket;

a mouth portion between said front and back walls leading to said pocket;

complementary separable zipper profiles on said front and back walls at said mouth portion to allow the bag to be openable and closeable;

a back wall extension portion formed by said rear wall extending beyond the upper edge of said front wall, said back wall extension portion extending above said zipper profiles; and a perforation extending from one side to the other side of said back wall extension portion above said zipper profiles in spaced parallel relation to the upper edges of said front and rear walls;

wherein the strength of said zipper profiles is greater than the strength of said perforation such that pulling on said zipper profiles when the zipper profiles are closed tears said bag from its dispenser without causing said zipper profiles to separate.

2. The plurality of stacked openable and reclosable plastic film bags of claim 1 further comprising a lip attached to said front wall below said zipper profiles.

3. The plurality of stacked openable and reclosable plastic film bags of claim 1 further comprising a lip attached to said front wall above said zipper profiles.

4. The plurality of stacked openable and reclosable plastic film bags of claim 1 wherein said stacked bags are attached to one another at a part on each back wall extension portion above each respective perforation.

5. The plurality of stacked openable and reclosable plastic film bags of claim 1 wherein said back wall extension portion extends over the top of the stacked plastic bags above the perforation, said back wall extension portion also extending partially down behind the back walls of said bags.

6. The plurality of stacked openable and reclosable plastic film bags of claim 5 further including a dispenser card from which said back wall extension portion and said bags are suspended.

7. The plurality of stacked openable and reclosable plastic film bags of claim 6 wherein said dispenser card includes mounting means for mounting said bags to enable the filling of said bags while said bags are connected to said dispenser and to enable the dispensing of said bags.

8. The plurality of stacked openable and reclosable plastic film bags of claim 1 wherein said perforation is a score line along said back wall extension portion.

* * * * *